US011694618B2

(12) United States Patent
Xue

(10) Patent No.: US 11,694,618 B2
(45) Date of Patent: Jul. 4, 2023

(54) PIXEL DRIVING CIRCUIT AND DISPLAY PANEL

(71) Applicant: Shenzhen China Star Optoelectronics Semiconductor Display Technology Co., Ltd., Shenzhen (CN)

(72) Inventor: Yan Xue, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 17/253,137

(22) PCT Filed: Mar. 27, 2020

(86) PCT No.: PCT/CN2020/081563

§ 371 (c)(1),
(2) Date: Dec. 17, 2020

(87) PCT Pub. No.: WO2021/174616

PCT Pub. Date: Sep. 10, 2021

(65) Prior Publication Data

US 2022/0398977 A1 Dec. 15, 2022

(30) Foreign Application Priority Data

Mar. 4, 2020 (CN) ..... 202010142628.0

(51) Int. Cl.

| | |
|---|---|
| ***G09G 3/3233*** | (2016.01) |
| ***G09G 3/3266*** | (2016.01) |
| ***G09G 3/3291*** | (2016.01) |

(52) U.S. Cl.

CPC ..... *G09G 3/3233* (2013.01); *G09G 3/3266* (2013.01); *G09G 3/3291* (2013.01); *G09G 2300/0819* (2013.01); *G09G 2330/021* (2013.01)

(58) Field of Classification Search

CPC .. G09G 3/3225; G09G 3/3233; G09G 3/3266; G09G 3/3291; G09G 2300/0819; G09G 2320/0233; G09G 2330/021

See application file for complete search history.

(56) References Cited

U.S. PATENT DOCUMENTS

| | | | |
|---|---|---|---|
| 2016/0063922 | A1 | 3/2016 | Tsai |
| 2016/0379570 | A1 | 12/2016 | Lee et al. |
| 2017/0221422 | A1 | 8/2017 | Hwang et al. |
| 2017/0330511 | A1 | 11/2017 | Feng |

(Continued)

FOREIGN PATENT DOCUMENTS

| | | | |
|---|---|---|---|
| CN | 104200771 | A | 12/2014 |
| CN | 104715716 | A | 6/2015 |

(Continued)

*Primary Examiner* — Stacy Khoo

(74) *Attorney, Agent, or Firm* — Nathan & Associates; Menachem Nathan

(57) ABSTRACT

A pixel driving circuit and a display panel are provided, and adopt a pixel driving circuit of 5T1C structure to effectively compensate the threshold voltage of the driving transistor in each pf the pixels. The pixel driving circuit can effectively reduce leakage power consumption of a pixel driving circuit when extracting a threshold voltage, thereby improving compensation accuracy of the pixel driving circuit.

18 Claims, 4 Drawing Sheets

(56) References Cited

U.S. PATENT DOCUMENTS

| | | | | |
|---|---|---|---|---|
| 2018/0047337 | A1 | 2/2018 | Zhu et al. | |
| 2018/0330670 | A1 | 11/2018 | Han et al. | |
| 2020/0043410 | A1 | 2/2020 | Ka et al. | |
| 2020/0327853 | A1 | 10/2020 | Li | |
| 2021/0366362 | A1* | 11/2021 | Xuan | G09G 3/3233 |

FOREIGN PATENT DOCUMENTS

| | | | |
|---|---|---|---|
| CN | 104992674 | A | 10/2015 |
| CN | 105161051 | A | 12/2015 |
| CN | 106297666 | A | 1/2017 |
| CN | 106486053 | A | 3/2017 |
| CN | 106910468 | A | 6/2017 |
| CN | 107564467 | A | 1/2018 |
| CN | 108288453 | A | 7/2018 |
| CN | 109192140 | A | 1/2019 |
| CN | 109473063 | A | 3/2019 |
| JP | 2016038402 | A | 3/2016 |

* cited by examiner

PIXEL DRIVING CIRCUIT AND DISPLAY PANEL

FIELD OF INVENTION

The present disclosure relates to the technical field of display, and in particular, relates to a pixel driving circuit and a display panel.

BACKGROUND OF INVENTION

Active matrix organic light emitting displays (AMOLED) as a new generation display technology, have high contrast, fast response times, and wider viewing angles, and have been widely used in the field of high-performance displays. In terms of driving method, AMOLEDs are a current driven type, which are more sensitive to the electrical variation of the transistors. The uniformity and drift of the threshold voltage Vth of the transistors affect the accuracy and uniformity of the display. In order to solve this problem, pixel compensation circuits are usually introduced.

Printed display technology is one of the important directions for the development of AMOLED. However, the printed OLED devices have a low turn-on voltage, and the use of traditional pixel compensation circuits results in high leakage power consumption and low compensation accuracy.

SUMMARY OF INVENTION

Technical Problem

The printed OLED devices have a low turn-on voltage, and the use of traditional pixel compensation circuits results in high leakage power consumption and low compensation accuracy. An embodiment of the present disclosure provides a pixel driving circuit with a 5T1C structure, which effectively compensates the threshold voltage of the driving transistor in each of the pixels. It can effectively reduce the leakage power consumption of the display panel when extracting the threshold voltage, thereby improving the compensation accuracy of the pixel driving circuit.

Technical Solution

An embodiment of the present disclosure provides a pixel driving circuit and a display panel, which is to solve the technical problems of high leakage power consumption and low consumption accuracy of the pixel driving circuit in the prior art.

The present disclosure provides a pixel driving circuit, which comprises a first transistor, a second transistor, a third transistor, a fourth transistor, a fifth transistor, a capacitor, and a light emitting element; a gate of the first transistor is electrically connected to a first node, a source of the first transistor is electrically connected to a second node, and a drain of the first transistor is connected to receive a power voltage; a gate of the second transistor is connected to receive a first scanning signal, a source of the second transistor is connected to receive a data signal, and a drain of the second transistor is electrically connected to the first node; a gate of the third transistor is connected to a second scanning signal, a source of the third transistor is connected to receive a reference signal, and a drain of the third transistor is electrically connected to the second node; a gate of the fourth transistor is connected to receive a readjusting signal, a source of the fourth transistor is connected to receive a reset signal, and a drain of the fourth transistor is electrically connected to the first node; a gate of the fifth transistor is connected to receive a control signal, a source of the fifth transistor is electrically connected to the second node, and a drain of the fifth transistor is electrically connected to an anode of the light emitting element; a first end of the capacitor is electrically connected to the first node, and a second end of the capacitor is electrically connected to the second node; the anode of the light emitting element is electrically connected to the drain of the fifth transistor, and a cathode of the light emitting element is grounded.

In the pixel driving circuit of the present disclosure, the first transistor, the second transistor, the third transistor, the fourth transistor, and the fifth transistor are all the same type of transistor.

In the pixel driving circuit of the present disclosure, the driving timing of the pixel driving circuit includes: a first reset stage, resetting a potential of the second node; a second reset stage, resetting a potential of the first node; a threshold voltage extraction stage, extracting a threshold voltage of the first transistor and storing in the capacitor; and a data writing stage, writing the data signal to the first end of the capacitor so that a potential of the second end of the capacitor jumps to a corresponding potential according to a coupling effect of the capacitor.

In the pixel driving circuit of the present disclosure, in the first reset stage, the second scanning signal and the control signal are at a high potential, the first scanning signal and the readjusting signal are at a low potential, and the reference signal is transmitted to the second node through the third transistor.

In the pixel driving circuit of the present disclosure, in the second reset stage, the second scanning signal and the readjusting signal are at a high potential, the first scanning signal and the control signal are at a low potential, and the reset signal is transmitted to the first node through the fourth transistor.

In the pixel driving circuit of the present disclosure, in the threshold voltage extraction stage, the first scanning signal, the second scanning signal, and the control signal are at a low potential, the readjusting signal is at a high potential, and the reset signal charges the capacitor through the fourth transistor until a voltage difference between the gate and the source of the first transistor is equal to the threshold voltage of the first transistor and is turned off.

In the pixel driving circuit of the present disclosure, in the data writing stage, the first scanning signal is at a high potential, the second scanning signal and the readjusting signal are at a low potential, the data signal is transmitted to the first end of the capacitor through the second transistor, and the potential of the second node jumps to a corresponding potential according to the coupling effect of the capacitor.

In the pixel driving circuit of the present disclosure, in the data writing stage, the control signal is switched from a low potential to a high potential, the power voltage is transmitted to the cathode of the light emitting element through the anode of the light emitting element, and the light emitting element emits light.

In the pixel driving circuit of the present disclosure, electric current flowing through the light emitting element is independent of the threshold voltage of the first transistor.

The present disclosure further provides a display panel, which comprises a pixel driving circuit, wherein the pixel driving circuit includes: a first transistor, a second transistor, a third transistor, a fourth transistor, a fifth transistor, a capacitor, and a light emitting element; a gate of the first transistor is electrically connected to a first node, a source of the first transistor is electrically connected to a second node, and a drain of the first transistor is connected to receive a power voltage; a gate of the second transistor is connected to receive a first scanning signal, a source of the second transistor is connected to receive a data signal, and a drain of the second transistor is electrically connected to the first node; a gate of the third transistor is connected to receive a second scanning signal, a source of the third transistor is connected to receive a reference signal, and a drain of the third transistor is electrically connected to the second node; a gate of the fourth transistor is connected to receive a readjusting signal, a source of the fourth transistor is connected to a reset signal, and a drain of the fourth transistor is electrically connected to the first node; a gate of the fifth transistor is connected to receive a control signal, a source of the fifth transistor is electrically connected to the second node, and a drain of the fifth transistor is electrically connected to an anode of the light emitting element; a first end of the capacitor is electrically connected to the first node, and a second end of the capacitor is electrically connected to the second node; the anode of the light emitting element is electrically connected to the drain of the fifth transistor, and a cathode of the light emitting element is grounded.

In the display panel of the present disclosure, the first transistor, the second transistor, the third transistor, the fourth transistor, and the fifth transistor are all the same type of transistor.

In the display panel of the present disclosure, the driving timing of the pixel driving circuit includes: a first reset stage, resetting a potential of the second node; a second reset stage, resetting a potential of the first node; a threshold voltage extraction stage, extracting a threshold voltage of the first transistor and storing in the capacitor; and a data writing stage, writing the data signal to the first end of the capacitor so that a potential of the second end of the capacitor jumps to a corresponding potential according to a coupling effect of the capacitor.

In the display panel of the present disclosure, in the first reset stage, the second scanning signal and the control signal are at a high potential, the first scanning signal and the readjusting signal are at a low potential, and the reference signal is transmitted to the second node through the third transistor.

In the display panel of the present disclosure, in the second reset stage, the second scanning signal and the readjusting signal are at a high potential, the first scanning signal and the control signal are at a low potential, and the reset signal is transmitted to the first node through the fourth transistor.

In the display panel of the present disclosure, in the threshold voltage extraction stage, the first scanning signal, the second scanning signal, and the control signal are at a low potential, the readjusting signal is at a high potential, and the reset signal charges the capacitor through the fourth transistor until the voltage difference between the gate and the source of the first transistor is equal to the threshold voltage of the first transistor and is turned off.

In the display panel of the present disclosure, in the data writing stage, the first scanning signal is at a high potential, the second scanning signal and the readjusting signal are at a low potential, the data signal is transmitted to the first end of the capacitor through the second transistor, and the potential of the second node jumps to a corresponding potential according to the coupling effect of the capacitor.

In the display panel of the present disclosure, in the data writing stage, the control signal is switched from a low potential to a high potential, the power voltage is transmitted to the cathode of the light emitting element through the anode of the light emitting element, and the light emitting element emits light.

In the display panel of the present disclosure, electric current flowing through the light emitting element is independent of the threshold voltage of the first transistor.

Correspondingly, the present disclosure further provides a display panel, and the display panel includes the pixel driving circuit described above.

Beneficial Effects

The pixel driving circuit and the display panel provided by the embodiments of the present disclosure adopt a pixel driving circuit of 5T1C structure to effectively compensate the threshold voltage of the driving transistor in each pf the pixels. The pixel driving circuit can effectively reduce the leakage power consumption of the display panel when extracting the threshold voltage, thereby improving the compensation accuracy of the pixel driving circuit.

DESCRIPTION OF DRAWINGS

In order to more clearly illustrate technical solutions in embodiments of the present disclosure, the drawings used in the description of the embodiments will be briefly introduced below. Obviously, the drawings in the following description are only some embodiments of the present disclosure, and those skilled in the art can obtain other drawings according to these drawings without any creative effort.

DETAILED DESCRIPTION OF PREFERRED EMBODIMENTS

Figure 1:
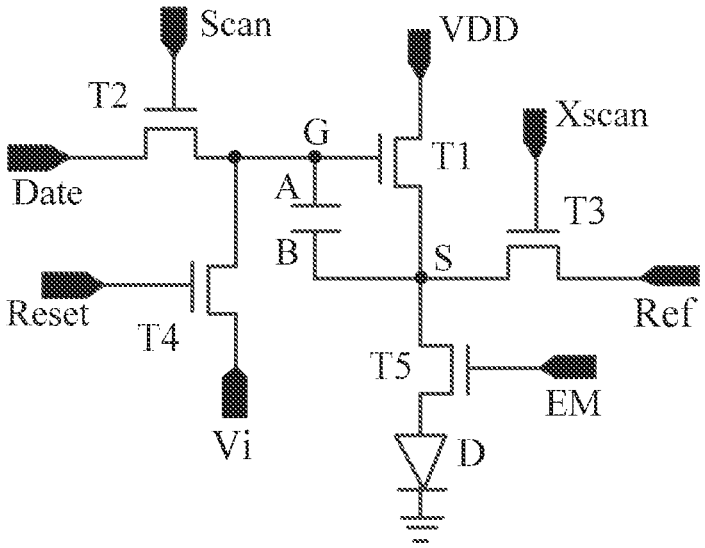
FIG. 1 is a schematic structural diagram of a pixel driving circuit according to an embodiment of the present disclosure.

The technical solutions in the embodiments of the present disclosure will be described clearly and completely below with reference to the drawings in the embodiments of the present disclosure. Obviously, the described embodiments are only a part of the embodiments of the present disclosure, but not all the embodiments. Based on the embodiments in the present disclosure, all other embodiments obtained by those skilled in the art without making creative work fall within the protection scope of the present disclosure.

In the description of the present disclosure, it should be understood that the terms "first" and "second" are used for description purposes only, and cannot be understood as indicating or implying relative importance or implicitly indicating the number of technical features indicated. Thus, features defined as "first" and "second", etc., may explicitly or implicitly include one or more of the aforementioned features, and therefore cannot be construed as a limitation of the present disclosure.

The transistors used in all the embodiments of the present disclosure may be thin film transistors, field effect transistors or other devices with the same characteristics. Since the source and drain of the transistor used here are symmetrical, the source and drain are interchangeable. In the embodiment of the present disclosure, in order to distinguish the two electrodes of the transistor except the gate, one of the electrodes is called a source, and the other electrode is called a drain. According to the form in the drawings, the middle end of the switching transistor is a gate, the signal input end is a source, and the output end is a drain. In addition, the transistors used in the embodiments of the present disclosure may include two types of P-type transistors and/or N-type transistors, wherein the P-type transistor is turned on when the gate is at a low level, and is turned off when the gate is at a high level, and the N-type transistor is turned on when the gate is at a high level, and turned off when the gate is at a low level.

Referring to FIG. 1, which is a schematic structural diagram of a pixel driving circuit according to an embodiment of the present disclosure. The present disclosure provides a pixel driving circuit, wherein the pixel driving circuit comprises a first transistor T1, a second transistor T2, a third transistor T3, a fourth transistor T4, a fifth transistor T5, a capacitor C, and a light emitting element D. The light emitting element D may be an organic light emitting diode. The embodiment of the present disclosure uses a pixel driving circuit with a 5T1C structure to effectively compensate the threshold voltage Vth of the driving transistor in each of the pixels. By providing the fifth transistor T5, the leakage power consumption of the display panel when extracting the threshold voltage can be effectively reduced, thereby improving the compensation accuracy of the pixel driving circuit. The first transistor T1 in the pixel driving circuit is a driving transistor.

A gate of the first transistor T1 is electrically connected to a first node G. A source of the first transistor T1 is electrically connected to a second node S. A drain of the first transistor T1 is connected to receive a power voltage VDD. A gate of the second transistor T2 is connected to receive a first scanning signal Scan. A source of the second transistor T2 is connected to receive a data signal Date. A drain of the second transistor T2 is electrically connected to the first node G. A gate of the third transistor T3 is connected to receive a second scanning signal Xscan. A source of the third transistor T3 is connected to receive a reference signal Ref. A drain of the third transistor T3 is electrically connected to the second node S. A gate of the fourth transistor T4 is connected to receive a readjusting signal Reset. A source of the fourth transistor T4 is connected to receive a reset signal Vi. A drain of the fourth transistor T4 is connected to the first node G. A gate of the fifth transistor T5 is connected to a control signal EM. A source of the fifth transistor T5 is electrically connected to the second node S. A drain of the fifth transistor T5 is electrically connected to the anode of the light emitting element D. A first end A of the capacitor C is electrically connected to the first node G. A second B of the capacitor C is electrically connected to the second node S. The anode of the light emitting element D is electrically connected to the drain of the fifth transistor T5. A cathode of the light emitting element D is grounded.

In some embodiments, the first transistor T1, the second transistor T2, the third transistor T3, the fourth transistor T4, and the fifth transistor T5 are all low-temperature polysilicon thin film transistor, oxide semiconductor thin film transistor, or amorphous silicon thin film transistor. The transistor in the pixel driving circuit provided by the embodiments of the present disclosure are all the same type of transistor, so as to avoid the influence of the difference between the different types of transistors on the pixel driving circuit.

Figure 2:
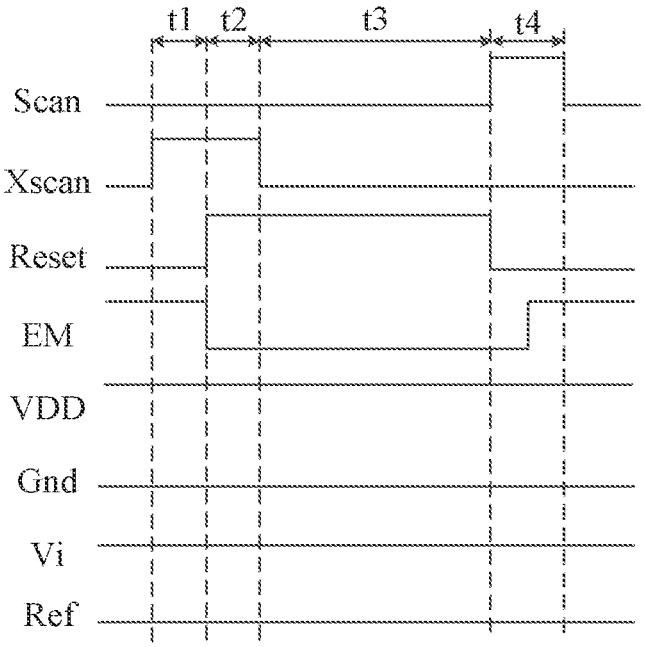
FIG. 2 is a timing diagram of a pixel driving circuit according to an embodiment of the present disclosure.

Referring to FIG. 2, which is a timing diagram of a pixel driving circuit according to an embodiment of the present disclosure. The combination of the first scanning signal Scan, the second scanning signal Xscan, the readjusting signal Reset, and the control signal EM successively corresponds to different stages of the pixel driving circuit.

Specifically, the pixel driving circuit provided by the embodiment of the present disclosure includes a first reset stage t1, resetting a potential of the second node S; a second reset stage t2, resetting a potential of the first node G; a threshold voltage extraction stage t3, extracting a threshold voltage of the first transistor T1 and storing in the capacitor C; and a data writing stage t4, writing the data signal Data to the first end A of the capacitor C so that a potential of the second end B of the capacitor C jumps to a corresponding potential according to a coupling effect of the capacitor C.

In some embodiments, in the first reset stage t1, the second scanning signal Xscan is at a high potential, the control signal EM is at a high potential, the first scanning signal Scan is at a low potential, and the readjusting signal Reset is at a low potential.

In some embodiments, in the second reset stage t2, the second scanning signal Xscan is at a high potential, the readjusting signal Reset is at a high potential, the first scanning signal Scam is at a low potential, and the control signal EM is at a low potential.

In some embodiments, in the threshold voltage extraction stage t3, the first scanning signal Scan is at a low potential, the second scanning signal Xscan is at a low potential, the control signal EM is at a low potential, the readjusting signal Reset is at a high potential, and the reset signal Vi charges the capacitor C through the fourth transistor T4 until a voltage difference Vgs between the gate and the source of the first transistor T1 is equal to the threshold voltage Vth of the first transistor T1.

In some embodiments, in the data writing stage t4, the first scanning signal Scan is at a high potential, the second scanning signal Xscan is at a low potential, the readjusting signal Reset is at a low potential. It should be noted that, during the data writing stage, the control signal EM is switched from a low potential to a high potential.

Figure 3:
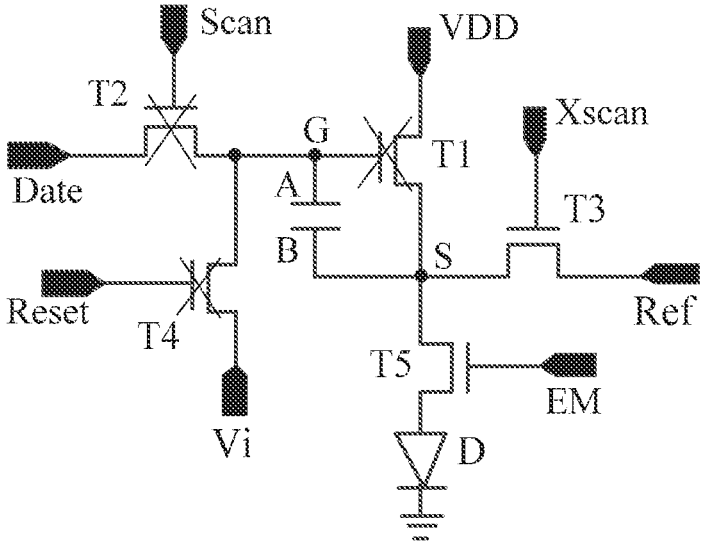
FIG. 3 is a circuit diagram of a pixel driving circuit according to an embodiment of the present disclosure in a first reset stage of a driving timing shown in FIG. 2.

Referring FIG. 3, which is a circuit diagram of a pixel driving circuit according to an embodiment of the present disclosure in a first reset stage t1 of a driving timing shown in FIG. 2. Referring to FIG. 2 and FIG. 3, in the first reset stage t1, the second scanning signal Xscan is at a high potential, the control signal EM is at a high potential, the first scanning signal Scan is at a low potential, and the readjusting signal Reset is at a low potential. At this time, the first transistor T1, the second transistor T2, and the fourth transistor T4 are turned off, and the third transistor T3 and the fifth transistor T5 are turned on.

Specifically, since the second scanning signal Xscan is at a high potential, the third transistor T3 is turned on, and the reference signal Ref is transmitted to the second node S through the third transistor T3. Since the reference signal Ref is at a low potential, the potential of the second node S is pulled to a low potential, and the light emitting element D is turned off and does not emit light.

Since the control signal EM is at a high potential, the fifth transistor T5 is turned on. It should be noted that in the first reset stage, the control signal EM is at a high potential, which is a signal that continues form the previous stage. In addition, since both the first scanning signal Scan and the readjusting signal Reset are at a low potential, the first transistor T1, the second transistor T2, and the fourth transistor T4 are turned off.

Figure 4:
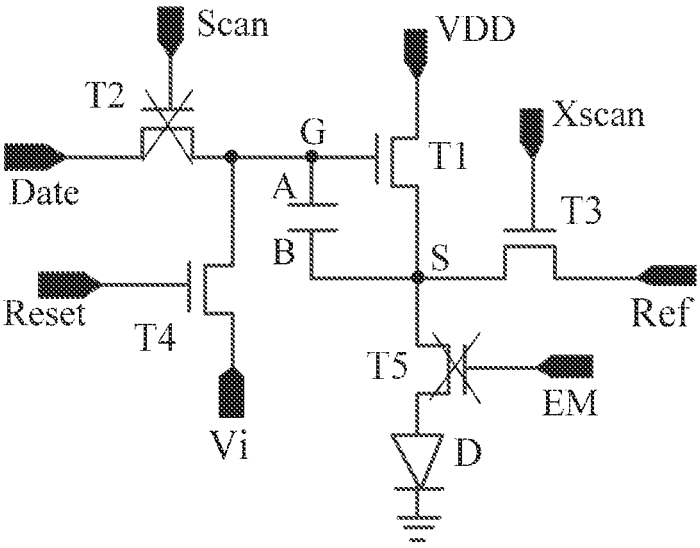
FIG. 4 is a circuit diagram of a pixel driving circuit according to an embodiment of the present disclosure in a second reset stage of a driving timing shown in FIG. 2.

Referring to FIG. 4, which is a circuit diagram of a pixel driving circuit according to an embodiment of the present disclosure in a second reset stage t2 of a driving timing shown in FIG. 2. Referring to FIG. 2 and FIG. 4, in the second reset stage t2, the second scanning signal Xscan is at a high potential, the readjusting signal Reset is at a high potential, the first scanning signal Scan is at a low potential, and the control signal EM is at a low potential. At this time, the first transistor T1, the third transistor T3, the fourth transistor T4 are turned on, and the second transistor T2 and the fifth transistor T5 are turned off.

Specifically, since the readjusting signal Reset is at a high potential, the fourth transistor T4 is turned on, and the reset signal Vi is transmitted to the first node G through the fourth transistor T4. Furthermore, since the reset signal Vi written by the first node G is at a high potential, the first transistor T1 is turned on, and electric current flows to second node S from VDD. In addition, since both the first scanning signal Scan and the control signal EM are at a low potential, the second transistor T2 and the fifth transistor T5 are turned off.

Figure 5:
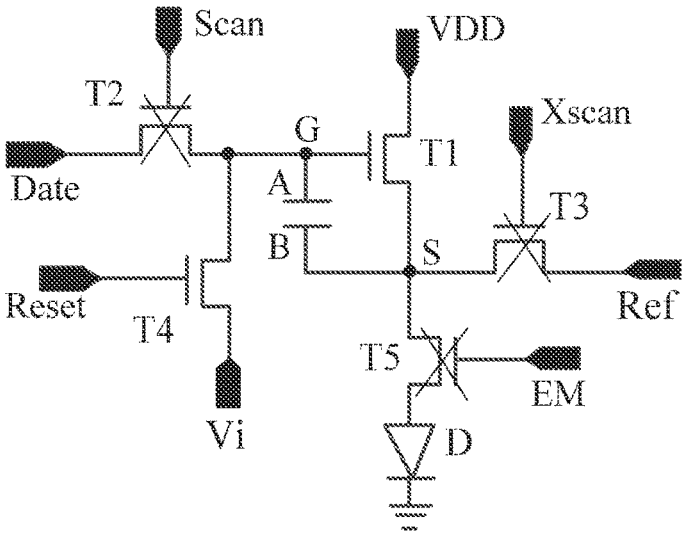
FIG. 5 is a circuit diagram of a pixel driving circuit according to an embodiment of the present disclosure in a threshold voltage extraction stage of a driving timing shown in FIG. 2.

Referring to FIG. 5, which is a circuit diagram of a pixel driving circuit according to an embodiment of the present disclosure in a threshold voltage extraction stage t3 of a driving timing shown in FIG. 2. Referring to FIG. 2 and FIG. 5, in the threshold voltage extraction stage t3, the first scanning signal Scan is at a low potential, the control signal EM is at low potential, and the readjusting signal Reset is at a high potential. At the time, the first transistor T1 and the fourth transistorT4 are turned on, and the second transistor T2, the third transistor T3, and the fifth transistor T5 are turned off.

Specifically, since the readjusting signal Reset is at a high potential, the fourth transistor T4 is turned on, and the reset signal Vi is transmitted to the first node G through the fourth transistor T4. Furthermore, since the reset signal Vi written in the first node G is at a high potential, the first transistor T1 is turned on, and electric current flows to the second node S from VDD. At the time, since the first scanning signal Scan, the second scanning signal Xscan, and the control signal EM are all at a low potential, the third transistor T3 and the fifth transistor T5 are all turned off. Thus, the electric current cannot flow out from the second node S, and the potential of the second node S will gradually increase. After the potential of the second node rises, the gate-source voltage Vgs of the first transistor T1 will gradually decrease. When the gate-source voltage Vgs of the first transistor T1 decreases to the threshold voltage Vth of the first transistor T1, the first transistor T1 will be turned off. Therefore, in theory, when the potential of the second node S rises to Vi-Vth at the maximum, the first transistor T1 is turned off. At this time, the threshold voltage Vth of the first transistor T1 is successfully detected and stored in the gate of the first transistor T1.

It should be noted that in the threshold voltage extraction stage t3, since the control signal EM is at a low potential, the fifth transistor T5 is turned off. Even if the turn-on voltage of the light emitting element D is low, it will not cause the voltage of the second node S to leak from the light emitting element D, which effectively reduces the leakage power of the display panel, thereby improving the compensation accuracy of the pixel driving circuit.

Figure 6:
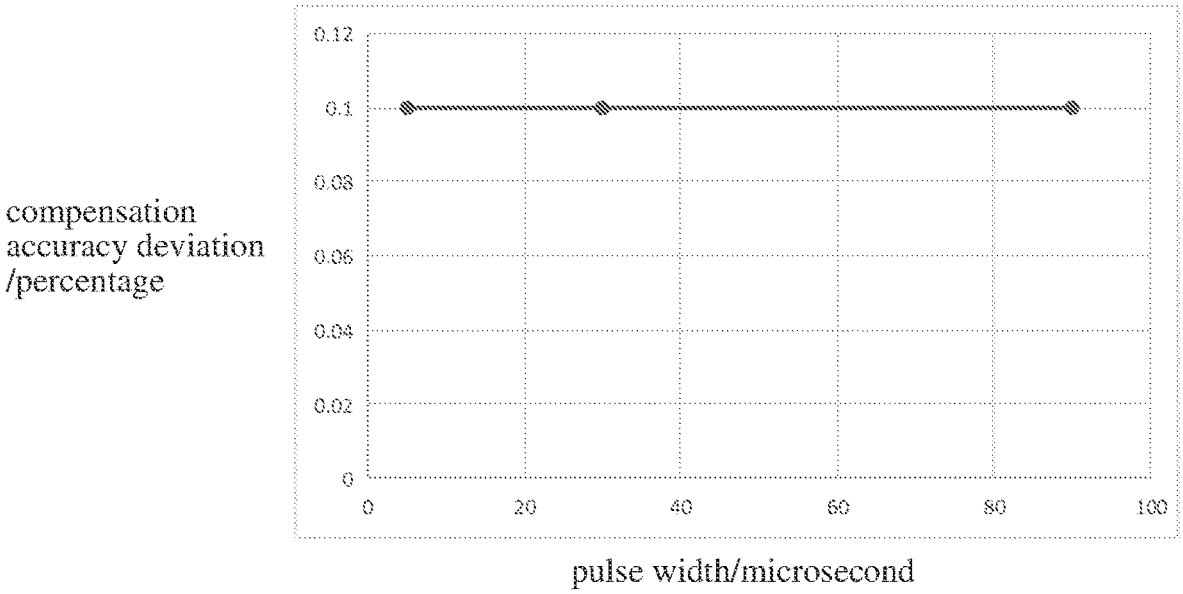
FIG. 6 is a variation curve of a threshold voltage compensation accuracy deviation value of a pixel driving circuit according to an embodiment of the present disclosure.

Specifically, in the embodiment of the present disclosure, when the threshold voltage Vth of the driving transistor is −1V, the compensation accuracy of the pixel driving circuit changes with the extraction time of the threshold voltage Vth, as shown in FIG. 6. It can be seen that when the extraction time of the threshold voltage Vth of the driving transistor is increased frim 10 microseconds to 90 microseconds, the compensation accuracy deviation value has been maintained at 0.1%, which effectively improves the compensation accuracy of the pixel driving circuit. The compensation deviation value is defined as (loled(after compensation)−loled(before compensation))/loled(before compensation).

Figure 7:
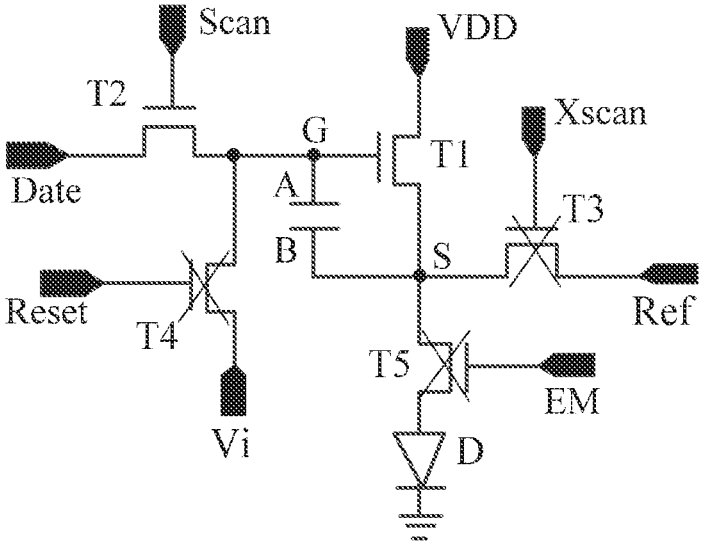
FIG. 7 is a first circuit diagram of a pixel driving circuit according to an embodiment of the present disclosure in a data writing stage of a driving timing shown in FIG. 2.

Referring to FIG. 7, which is a first circuit diagram of a pixel driving circuit according to an embodiment of the present disclosure in a data writing stage t4 of a driving timing shown in FIG. 2. Referring to FIG. 2 and FIG. 6, in an initial stage of the data writing stage t4, the first scanning signal Scan is at a high potential, the second scanning signal Xscan is at a low potential, the readjusting signal Reset is at a low potential, and the control signal EM is at a low potential. At this time, the first transistor T1 and the second transistor T2 are turned on, and the third transistor T3, the fourth transistor T4, and the fifth transistor T5 are turned off.

Specifically, since the First scanning signal Scan is at a high potential, the second transistor T2 is turned on, and the data signal Data is written into the first end A of the capacitor C through the second transistor T2. Since the data signal Data is at a high potential, the first transistor T1 is turned on.

Figure 8:
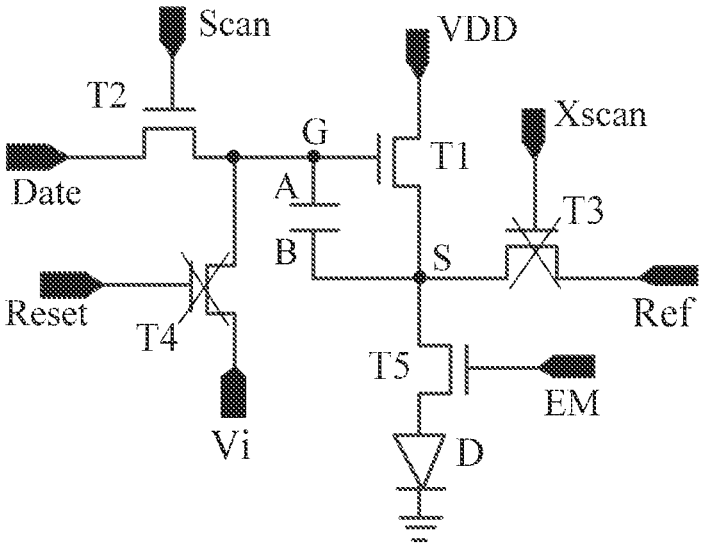
FIG. 8 is a second circuit diagram of a pixel driving circuit according to an embodiment of the present disclosure in a data writing stage of a driving timing shown in FIG. 2.

In addition, the role of the data writing stage t4 is to make the light emitting element D emit light. When the first scanning signal Scan rises to a high potential, the data signal Date is written to the first node G, the control signal EM is switched from a low potential to a high potential, so that the fifth transistor T5 is turned on. The electronic current is transmitted to the cathode of the light emitting element D through the anode of the light emitting device D, and the light emitting device D emits light. At this time, the second circuit diagram of the pixel driving circuit provided in the embodiment of the present disclosure in the data writing stage t4 at the driving timing shown in FIG. 2 is shown in FIG. 8.

It can be understood that there is a parasitic capacitance in the transistor. If the first scanning signal Scan and the control signal EM are switched from the low potential to the high potential at the same time, the potentials of the first node G and the second node S will be simultaneously lost, the gate-source voltage difference Vgs of the first transistor T1 changes greatly, and the first scanning signal Scan rises to a high potential before the control signal EM. At this time, the potential of the second node S is large, and the control signal EM is switched from a low potential to a high potential, and the influence on the potential of the second node S is relatively small.

In addition, when the first scanning signal Scan is switched from a low potential to a high potential, the second transistor T2 is turned on. When the data signal Data is written into the first end A of the capacitor C through the second transistor T2, the gate-source voltage difference of the first thin film transistor T1 is as follows: Vgs=Vg−Vs=Vdata−(Vi−Vth), Vgs−Vth=Vdata−Vi. Since the first transistor T1 operates in the saturation region, the electronic current flowing through the light emitting element D is as follows: I=k (Vgs−Vth) 2=k (Vdata−Vi) 2. The electronic current flowing through the light emitting element D is independent of the threshold voltage Vth of the first transistor T1, thereby ensuring that the current flowing through the light emitting element D remains unchanged. Even if the threshold voltage Vth drifts, it does not affect the normal light emission of the light emitting device D.

An embodiment of the present disclosure further provides a display panel, which includes the pixel driving circuit described above. For details, reference may be made to the above description of the pixel driving circuit, and details are not described herein.

The display panel provided by the embodiment of the present disclosure uses a pixel driving circuit with a 5T1C structure to effectively compensate the threshold voltage of the driving transistor in each of pixels. The compensation structure of the pixel driving circuit is relatively simple, which can effectively reduce the leakage power consumption of the display panel when extracting the threshold voltage, thereby improving the compensation accuracy of the pixel driving circuit.

The embodiments of the present disclosure have been described in detail above, and specific examples have been used to explain the principles and implementation of the present application. The descriptions of the above embodiments are only used to help understand the method of the present disclosure and its core idea. At the same time, for those of ordinary skill in the art, according to the ideas of the present disclosure, there will be changes in the specific implementation mode and scope. In summary, the content of this specification should not be understood as a limitation to the present disclosure.

What is claimed is:

1. A pixel driving circuit, comprising:

a first transistor, a second transistor, a third transistor, a fourth transistor, a fifth transistor, a capacitor, and a light emitting element;

wherein a gate of the first transistor is electrically connected to a first node, a source of the first transistor is electrically connected to a second node, and a drain of the first transistor is connected to receive a power voltage;

wherein a gate of the second transistor is connected to receive a first scanning signal, a source of the second transistor is connected to receive a data signal, and a drain of the second transistor is electrically connected to the first node;

wherein a gate of the third transistor is connected to a second scanning signal, a source of the third transistor is connected to receive a reference signal, and a drain of the third transistor is electrically connected to the second node;

wherein a gate of the fourth transistor is connected to receive a readjusting signal, a source of the fourth transistor is connected to receive a reset signal, and a drain of the fourth transistor is electrically connected to the first node;

wherein a gate of the fifth transistor is connected to receive a control signal, a source of the fifth transistor is electrically connected to the second node, and a drain of the fifth transistor is electrically connected to an anode of the light emitting element;

wherein a first end of the capacitor is electrically connected to the first node, and a second end of the capacitor is electrically connected to the second node;

wherein the anode of the light emitting element is electrically connected to the drain of the fifth transistor, and a cathode of the light emitting element is grounded; and wherein the first transistor is a driving transistor, the gate of the first transistor is connected to the source of the first transistor via the capacitor, and the drain of the third transistor is connected to the second end of the capacitor via the second node.

2. The pixel driving circuit according to claim 1, wherein the first transistor, the second transistor, the third transistor, the fourth transistor, and the fifth transistor are all the same type of transistor.

3. The pixel driving circuit according to claim 2, wherein driving timing of the pixel driving circuit comprises:

a first reset stage, resetting a potential of the second node;

a second reset stage, resetting a potential of the first node;

a threshold voltage extraction stage, extracting a threshold voltage of the first transistor and storing in the capacitor; and a data writing stage, writing the data signal to the first end of the capacitor so that a potential of the second end of the capacitor jumps to a corresponding potential according to a coupling effect of the capacitor.

4. The pixel driving circuit according to claim 3, wherein in the first reset stage, the second scanning signal and the control signal are at a high potential, the first scanning signal and the readjusting signal are at a low potential, and the reference signal is transmitted to the second node through the third transistor.

5. The pixel driving circuit according to claim 3, wherein in the second reset stage, the second scanning signal and the readjusting signal are at a high potential, the first scanning signal and the control signal are at a low potential, and the reset signal is transmitted to the first node through the fourth transistor.

6. The pixel driving circuit according to claim 3, wherein in the threshold voltage extraction stage, the first scanning signal, the second scanning signal, and the control signal are at a low potential, the readjusting signal is at a high potential, and the reset signal charges the capacitor through the fourth transistor until a voltage difference between the gate and the source of the first transistor is equal to the threshold voltage of the first transistor and is turned off.

7. The pixel driving circuit according to claim 3, wherein in the data writing stage, the first scanning signal is at a high potential, the second scanning signal and the readjusting signal are at a low potential, the data signal is transmitted to the first end of the capacitor through the second transistor, and the potential of the second node jumps to a corresponding potential according to the coupling effect of the capacitor.

8. The pixel driving circuit according to claim 7, wherein in the data writing stage, the control signal is switched from a low potential to a high potential, the power voltage is transmitted to the cathode of the light emitting element through the anode of the light emitting element, and the light emitting element emits light.

9. The pixel driving circuit according to claim 1, wherein electric current flowing through the light emitting element is independent of a threshold voltage of the first transistor.

10. A display panel comprising a pixel driving circuit, wherein the pixel driving circuit comprises:

a first transistor, a second transistor, a third transistor, a fourth transistor, a fifth transistor, a capacitor, and a light emitting element;

wherein a gate of the first transistor is electrically connected to a first node, a source of the first transistor is electrically connected to a second node, and a drain of the first transistor is connected to receive a power voltage;

wherein a gate of the second transistor is connected to receive a first scanning signal, a source of the second transistor is connected to receive a data signal, and a drain of the second transistor is electrically connected to the first node;

wherein a gate of the third transistor is connected to receive a second scanning signal, a source of the third transistor is connected to receive a reference signal, and a drain of the third transistor is electrically connected to the second node;

wherein a gate of the fourth transistor is connected to receive a readjusting signal, a source of the fourth transistor is connected to a reset signal, and a drain of the fourth transistor is electrically connected to the first node;

wherein a gate of the fifth transistor is connected to receive a control signal, a source of the fifth transistor is electrically connected to the second node, and a drain of the fifth transistor is electrically connected to an anode of the light emitting element;

wherein a first end of the capacitor is electrically connected to the first node, and a second end of the capacitor is electrically connected to the second node;

wherein the anode of the light emitting element is electrically connected to the drain of the fifth transistor, and a cathode of the light emitting element is grounded; and wherein the first transistor is a driving transistor, the gate of the first transistor is connected to the source of the first transistor via the capacitor, and the drain of the third transistor is connected to the second end of the capacitor via the second node.

11. The display panel according to claim 10, wherein the first transistor, the second transistor, the third transistor, the fourth transistor, and the fifth transistor are all the same type of transistor.

12. The display panel according to claim 11, wherein driving timing of the pixel driving circuit comprises:

a first reset stage, resetting a potential of the second node;

a second reset stage, resetting a potential of the first node;

a threshold voltage extraction stage, extracting a threshold voltage of the first transistor and storing in the capacitor; and a data writing stage, writing the data signal to the first end of the capacitor so that a potential of the second end of the capacitor jumps to a corresponding potential according to a coupling effect of the capacitor.

13. The display panel according to claim 12, wherein in the first reset stage, the second scanning signal and the control signal are at a high potential, the first scanning signal and the readjusting signal are at a low potential, and the reference signal is transmitted to the second node through the third transistor.

14. The display panel according to claim 12, wherein in the second reset stage, the second scanning signal and the readjusting signal are at a high potential, the first scanning signal and the control signal are at a low potential, and the reset signal is transmitted to the first node through the fourth transistor.

15. The display panel according to claim 12, wherein in the threshold voltage extraction stage, the first scanning signal, the second scanning signal, and the control signal are at a low potential, the readjusting signal is at a high potential, and the reset signal charges the capacitor through the fourth transistor until the voltage difference between the gate and the source of the first transistor is equal to the threshold voltage of the first transistor and is turned off.

16. The display panel according to claim 12, wherein in the data writing stage, the first scanning signal is at a high potential, the second scanning signal and the readjusting signal are at a low potential, the data signal is transmitted to the first end of the capacitor through the second transistor, and the potential of the second node jumps to a corresponding potential according to the coupling effect of the capacitor.

17. The display panel according to claim 12, wherein in the data writing stage, the control signal is switched from a low potential to a high potential, the power voltage is transmitted to the cathode of the light emitting element through the anode of the light emitting element, and the light emitting element emits light.

18. The display panel according to claim 10, wherein electric current flowing through the light emitting element is independent of a threshold voltage of the first transistor.

* * * * *